US007195327B2

(12) United States Patent
Kitami et al.

(10) Patent No.: US 7,195,327 B2
(45) Date of Patent: Mar. 27, 2007

(54) DROPLET EJECTION APPARATUS AND ITS DRIVE METHOD

(75) Inventors: Akiko Kitami, Hino (JP); Kazuo Asano, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 256 days.

(21) Appl. No.: 10/772,743

(22) Filed: Feb. 4, 2004

(65) Prior Publication Data

US 2004/0155915 A1 Aug. 12, 2004

(30) Foreign Application Priority Data

Feb. 12, 2003 (JP) ..... 2003-033311

(51) Int. Cl.
*B41J 29/38* (2006.01)

(52) U.S. Cl. ..... 347/11; 347/10

(58) Field of Classification Search ..... 347/10, 347/11

See application file for complete search history.

(56) References Cited

U.S. PATENT DOCUMENTS

| | | | | |
|---|---|---|---|---|
| 5,736,994 | A * | 4/1998 | Takahashi | 347/11 |
| 6,099,103 | A * | 8/2000 | Takahashi | 347/11 |
| 6,109,716 | A * | 8/2000 | Takahashi | 347/11 |
| 6,174,038 | B1 * | 1/2001 | Nakazawa et al. | 347/10 |
| 6,257,685 | B1 * | 7/2001 | Ishikawa | 347/10 |
| 6,260,959 | B1 * | 7/2001 | Takahashi | 347/68 |
| 6,350,003 | B1 * | 2/2002 | Ishikawa | 347/11 |
| 6,371,587 | B1 * | 4/2002 | Chang | 347/11 |
| 6,412,923 | B1 * | 7/2002 | Takahashi | 347/68 |
| 6,419,336 | B1 * | 7/2002 | Takahashi | 347/10 |
| 6,908,167 | B2 * | 6/2005 | Kitami et al. | 347/11 |
| 2001/0043242 | A1 * | 11/2001 | Takahashi | 347/10 |
| 2002/0060713 | A1 * | 5/2002 | Katakura et al. | 347/30 |

FOREIGN PATENT DOCUMENTS

| | | |
|---|---|---|
| JP | 11-268264 | 10/1999 |
| JP | 2000-094669 A | 4/2000 |

* cited by examiner

*Primary Examiner*—Stephen Meier
*Assistant Examiner*—Rene Garcia, Jr.
(74) *Attorney, Agent, or Firm*—Frishauf, Holtz, Goodman & Chick, P.C.

(57) ABSTRACT

A droplet ejection apparatus provided with: a drive signal generator for generating drive signals including a plurality of drive pulses; a drive pulse selector for selecting drive pulses in accordance with a print datum of each pixel; and a head for ejecting a droplet from a nozzle provided corresponding to a channel, by changing a volume of the channel according to the drive pulses selected, wherein, the drive signal includes a micro-vibration pulse as one of the drive pulses to generate a micro-vibration of meniscus in the nozzle in such a degree that the droplet is not ejected, said micro-vibration pulse being formed of rectangular waves which include at least one micro-vibration pulse having a pulse width of (2n) AL, where AL is ½ of the acoustic resonance period of the channel, and n is an integer not smaller than 1.

24 Claims, 12 Drawing Sheets

FIG. 4 ( a )
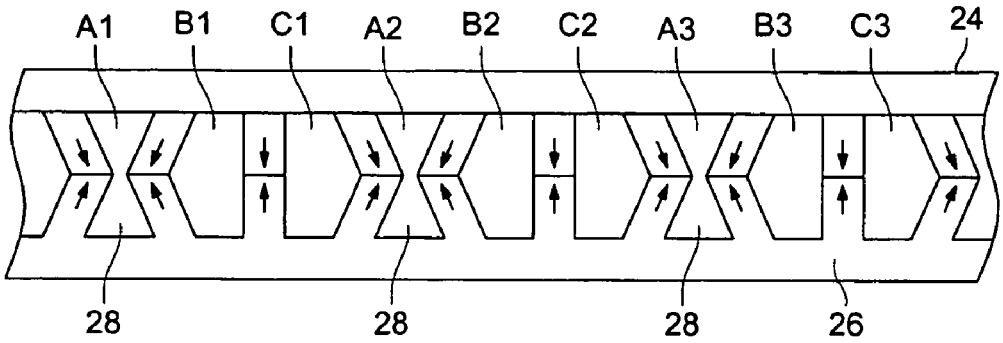
FIG. 4 ( b )
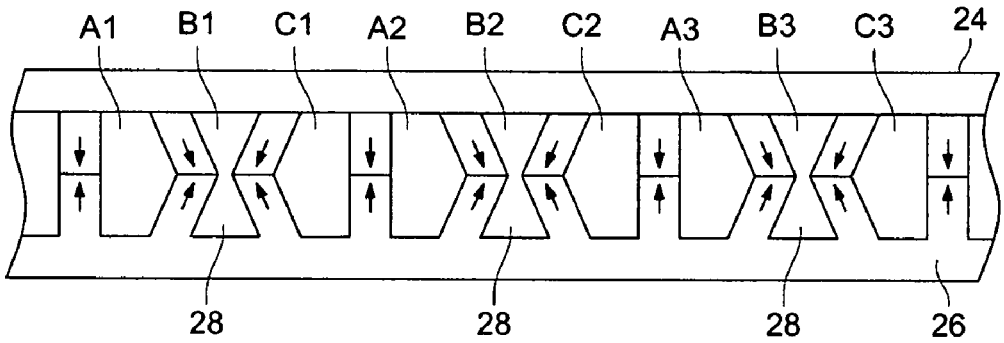
FIG. 4 ( c )
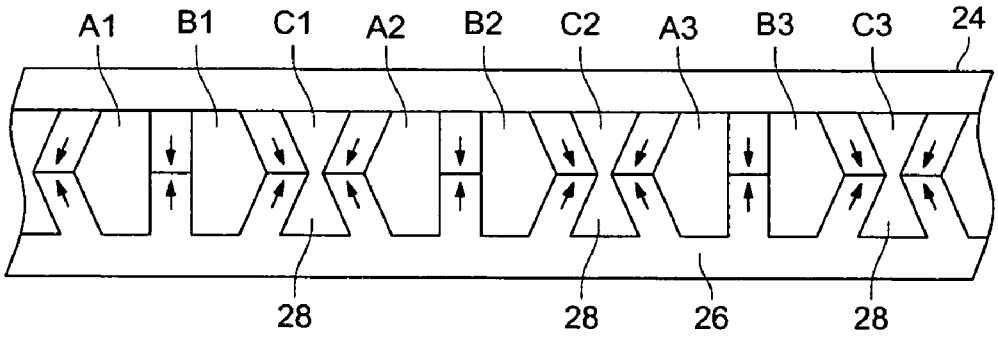

FIG. 10 ( a )
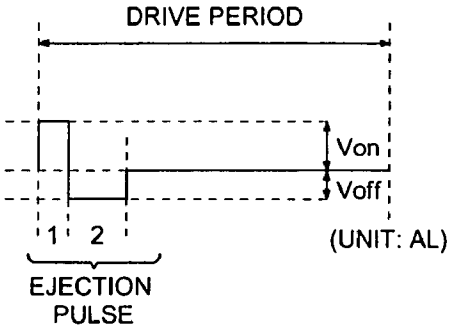
FIG. 10 ( b )
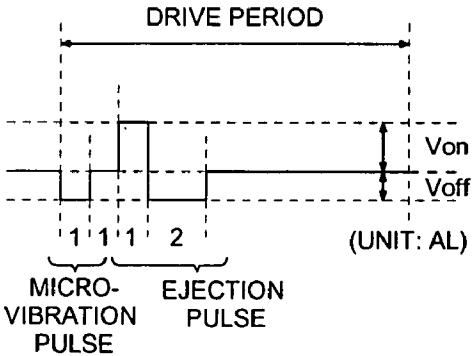
FIG. 10 ( c )
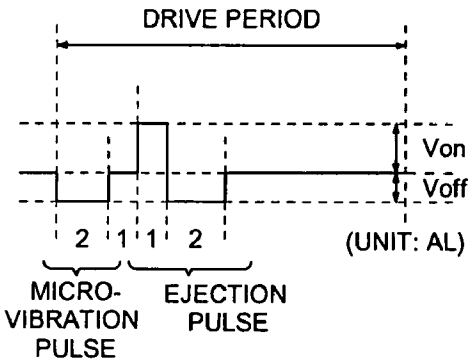
FIG. 10 ( d )
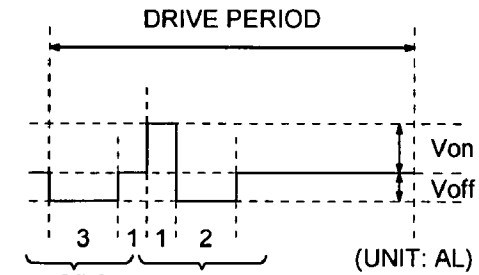
FIG. 10 ( e )
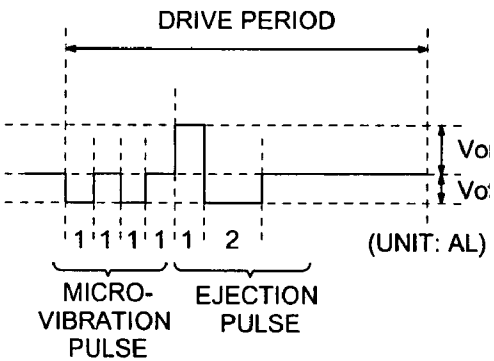
FIG. 10 ( f )
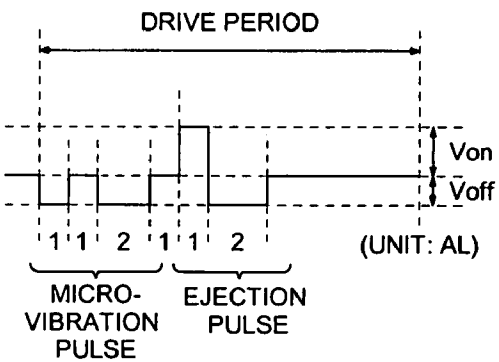

DROPLET EJECTION APPARATUS AND ITS DRIVE METHOD

BACKGROUND OF THE INVENTION

The present invention relates to a droplet ejection apparatus and its drive method, and in more detail, to a droplet ejection apparatus and its drive method in which, by applying a micro-vibration to a liquid meniscus in a nozzle in a degree in which the droplet is made not to be ejected, an increase of viscosity of the liquid in the nozzle is suppressed.

As a droplet ejection head in which the droplet is ejected from the nozzle when a volume of a channel is made changed, an ink jet recording head to record an inkjet image is well known.

The viscosity of the ink for the inkjet used for this inkjet recording head is, normally, about 2–5 cp (centipoise) in a room temperature. However, recently, accompanied with an offering of the high performance, additives are increased, and the ink with the high viscosity of 5–10 cp in the room temperature is also increased. Such a high viscosity ink is, as far as it is ejected under the normal temperature and normal humidity, when the drive voltage of the recording head is a little increased, it can be ejected, but because the viscosity is increased under the low temperature circumstance and is not smaller than 10 cp, and further, because the volatilization of the ink composition from the surface of the meniscus is fast under the low humidity circumstance, the ink viscosity of the nozzle surface is rapidly increased, and the ejection becomes very difficult.

As described above, it is very difficult to eject stably the ink whose viscosity is increased from the recording head under the low temperature circumstance and low humidity circumstance. For example, by also when the droplet ejection is interrupted for only a short period, when the ejection is re-started, it does not normally eject the ink from the first droplet, and the image quality is very lowered.

Conventionally, as one of countermeasures to suppress the increase of the ink viscosity of the nozzle surface, when the meniscus in the nozzle is applied micro-vibration in a degree in which the ink droplet is not ejected from the surface of the nozzle, a method by which the ink of the nozzle surface with increased viscosity is mixed with the ink in a channel is well known. And in the Patent Documents 1 and 2, when the micro-vibration is given to the surface of the nozzle under a condition in which the print is stopped, descriptions that the ink at the surface of the nozzle is mixed and the ink viscosity is lowered, are written.

[Patent Document 1] Tokkaihei No. 11-268264

[Patent Document 2] Tokkai No. 2000-94669

Under the low temperature and low humidity circumstance, because an increase of ink viscosity is very fast from the above reason, it is necessary that, after the micro-vibration is given to the meniscus, the ink droplet is ejected at once. Further, in order to conduct the stable ejection, it is necessary that the ink droplet is ejected after the vibration of the meniscus by the micro-vibration is turned down and under the condition that the meniscus position is settled at predetermined position, and when the ink droplet is ejected in a situation other than this, a size of the ejected ink droplet or the flying speed is varied, resulting in a cause of landing position error. Further, in order to effectively stir and mix the ink, it is necessary that the meniscus is largely vibrated, however, when the high frequency drive is conducted, the vibration of the meniscus needs to be attenuated early.

The method by which the meniscus of the ink is effectively swayed in this manner, or the residual vibration is effectively cancelled, can be explained from the acoustic theory as follows.

When a channel is expanded (or reduced), a pressure wave generated in the channel is, while the inversion of the pressure is repeated every 1 AL, gradually attenuated. In the case where a deformation of the channel is restored at the timing when the pressure is reversed after 1 AL after the channel is deformed, an initial pressure and a newly generated one are intensified together, and the meniscus of the ink is largely vibrated. Hereupon, the AL (Acoustic Length) is ½ of the acoustic resonance period of the channel. Accordingly, when the time after the channel is deformed, until it is restored, is made odd times of the AL, the meniscus can be largely vibrated. However, because the residual pressure is not cancelled, and the vibration of the meniscus remains, the ink droplet cannot be ejected at once.

On the other hand, in the case where the deformation of the channel is restored at the timing of 2 AL after, since the pressure is reversed and reversed again, the initial pressure and the newly generated pressure are cancelled out each other, the meniscus is not largely vibrated.

Accordingly, in the case where the time after the channel is deformed until the deformation is restored, is made even times of the AL, because the residual pressure is cancelled out, the vibration of the meniscus is turned down, and the nozzle becomes ready to eject the ink droplet at once, however, the meniscus can not be largely vibrated.

As can be seen from the above-description, in order to eject the high viscosity ink at the high frequency and stably under the low temperature and low humidity, it is necessary that the conflicting two conditions are attained, namely the meniscus needs to be largely vibrated so that the ink of the nozzle surface is effectively stirred, and the residual vibration generated by this vibration needs to be effectively cancelled out.

Both of the technology of the above-described Patent Documents 1 and 2 are technologies by which the micro-vibration pulse by a trapezoidal wave is applied on a nozzle in which the ink ejection is not conducted, and it is made in such a manner that the micro-vibration is given to the meniscus. Therefore, after the micro-vibration is given to the meniscus, because there is a time before the ink is ejected, the ink viscosity is increased again in that time, and particularly, under the low temperature and low humidity circumstance, there is a problem that the normal ejection becomes difficult. Further, in the trapezoidal wave, the circuit structure becomes complicated, and further, because the voltage sensibility becomes low, the necessary drive voltage is increased and the power consumption is increased. Further, when a number of times of applying of the micro-vibration pulse is not increased, the sufficient effect can not be obtained, and as a result, there is a problem that it results in a decrease of the printing speed.

Accordingly, the object of the present invention is to provide a droplet ejection apparatus and its drive method by which, when the liquid in the nozzle is effectively stirred, the improvement effect of the decapping characteristic is high even under the circumstance of the low temperature and low humidity, and even just after the micro-vibration of the meniscus, the droplet can be made to be stably ejected, and the high frequency and stable ejection can be conducted.

Herein, the decapping characteristic indicates a lowered amount of the initial flying speed by the so-called decapping phenomenon that, in the situation in which the nozzle surface is opened, the viscosity of the liquid is increased by the meniscus drying.

SUMMARY OF THE INVENTION

The above object can be solved by the following features of the invention.

(1) A droplet ejection apparatus comprising:

a drive signal generator for generating a set of drive signals including a plurality of drive pulses;

a drive pulse selector for selecting a set of drive pulses in accordance with a print datum of each pixel; and a head for ejecting a droplet from a nozzle provided corresponding to a channel, by changing a volume of the channel according to the set of drive pulses selected, wherein, the drive signal includes a micro-vibration pulse as one of the drive pulses to generate a micro-vibration of meniscus in the nozzle in such a degree that the droplet is not ejected, said micro-vibration pulse being formed of rectangular waves which include at least one micro-vibration pulse having a pulse width of (2n) AL, where AL is ½ of the acoustic resonance period of the channel, and n is an integer not smaller than 1.

(2) The droplet ejection apparatus according to (1), wherein the micro-vibration pulse includes a rectangular wave having a pulse width of 2 AL.

(3) The droplet ejection apparatus according to (1), wherein the micro-vibration pulse includes a rectangular wave having a pulse width of 1 AL and a rectangular wave having a pulse width of 2 AL.

(4) The droplet ejection apparatus according to any one of (1)–(3), wherein the micro-vibration pulse is applied before an ejection pulse for ejecting the droplet is applied.

(5) The droplet ejection apparatus according to any one of (1)–(4), wherein the rectangular wave having a pulse width of (2n) AL is applied at the last timing of the micro-vibration pulse.

(6) The droplet ejection apparatus according to (5), wherein the ejection pulse is applied after 1 AL from the time when the rectangular wave having the pulse width of (2n) AL is applied at the last timing of the micro-vibration pulse.

(7) The droplet ejection apparatus according to any one of (1)–(6), wherein the ejection pulse for ejecting the droplet comprising:

a first pulse formed of a rectangular wave to expand the volume of the channel, and 1 AL later, restoring it to an original state; and a second pulse formed of a rectangular wave to reduce the volume of the channel, and a prescribed period later, restoring it to the original state, wherein a voltage of the first pulse Von is higher than a voltage of the second pulse Voff.

(8) The droplet ejection apparatus according to (7), wherein the micro-vibration pulse is formed of a rectangular wave which reduces the volume of the channel, and subsequently restore to the original state, and a voltage of the micro-vibration pulse is same as the voltage Voff of the second pulse in the ejection pulse.

(9) The droplet ejection apparatus according to any one of (1)–(8), wherein the maximum extrusive amount of the meniscus by the micro-vibration pulse is not larger than a radius of the nozzle.

(10) The droplet ejection apparatus according to any one of (1)–(9), wherein the head comprises an electric-mechanical conversion element which changes the volume of the channel by the application of at least one of the ejection pulse or the micro-vibration pulse.

(11) The droplet ejection apparatus according to (10), wherein the electric-mechanical conversion element comprises a piezoelectric material which forms a partition wall between adjacent channels, and which is deformed in a shearing mode by applying a voltage.

(12) The droplet ejection apparatus according to any one of (1)–(11), wherein the droplet is an ink droplet.

(13) A drive method for a droplet ejection head, comprising:

generating a set of drive signals including a plurality of drive pulses by a drive signal generator;

selecting a set of drive pulses in accordance with a print datum of each pixel by a drive pulse selector;

ejecting a droplet by changing a volume of a channel according to the set of drive pulses selected, from a nozzle of the droplet ejection head, the nozzle being provided corresponding to the channel, wherein a micro-vibration pulse is applied onto the droplet ejection head to generate a micro-vibration of meniscus in the nozzle in such a degree that the droplet is not ejected, wherein, the drive signal includes a micro-vibration pulse as one of the drive pulses to generate a micro-vibration of meniscus in the nozzle in such a degree that the droplet is not ejected, said micro-vibration pulse being formed of rectangular waves which include at least one micro-vibration pulse having a pulse width of (2n) AL, where AL is ½ of the acoustic resonance period of the channel, and n is an integer not smaller than 1.

(14) The drive method according to (13), wherein the micro-vibration pulse includes a rectangular wave having a pulse width of 2 AL.

(15) The drive method according to (13), wherein the micro-vibration pulse includes a rectangular wave having a pulse width of 1 AL and a rectangular wave having a pulse width of 2 AL.

(16) The drive method according to any one of (13)–(15), wherein the micro-vibration pulse is applied before an ejection pulse for ejecting the droplet is applied.

(17) The drive method according to any one of (13)–(16), wherein the rectangular wave having the pulse width of (2n) AL is applied at the last timing of the micro-vibration pulse.

(18) The drive method according to (17), wherein the ejection pulse is applied after 1 AL from the time when the rectangular wave having the pulse width of (2n) AL is applied at the last timing of the micro-vibration pulse.

(19) The drive method according to any one of (13)–(18), wherein the ejection pulse for ejecting the droplet comprising:

a first pulse formed of a rectangular wave for expanding the volume of the channel, and 1 AL later, restoring it to an original state; and a second pulse formed of a rectangular wave for reducing the volume of the channel, and a prescribed period later, restoring it to the original state, wherein a voltage of the first pulse Von is higher than a voltage of the second pulse Voff.

(20) The drive method according to (19), wherein the micro-vibration pulse is formed of a rectangular wave to restore the volume of the channel to the original state after the volume of the channel have been reduced, and a voltage of the micro-vibration pulse is same as the voltage of the second pulse Voff.

(21) The drive method according to any one of (13)–(20), wherein the maximum extrusive amount of the meniscus by the micro-vibration pulse is not larger than a radius of the nozzle.

(22) The drive method according to any one of (13)–(21), wherein the head comprises an electric-mechanical conversion element for changing the volume of the channel by the apply ion of at least one of the ejection pulse or the micro-vibration pulse.

(23) The drive method according to (22), wherein the electric-mechanical conversion element comprises a piezoelectric material which forms a partition wall between adjacent channels, and which is deformed in a shearing mode by applying a voltage.

(24) The drive method according to any one of (13)–(23), wherein the droplet is an ink droplet.

According to the present invention, a conflicting problem which is a fact that the meniscus is largely vibrated, and the liquid on the nozzle surface is effectively stirred, and a fact that the residual vibration generated by this vibration is effectively cancelled out, can be solved, and when the liquid in the nozzle can be effectively stirred, the droplet ejection apparatus and its drive method in which even under the low temperature and low humidity circumstance, the improvement effect of the decapping characteristic is high, and further, even just after the micro-vibration of the meniscus, the droplet can be stably ejected, and the high frequency and stable ejection can be conducted, can be provided.

BRIEF DESCRIPTION OF THE DRAWINGS

FIGS. 4(*a*)–(*c*) are explanation views of time division motions of the recording head.

FIGS. 10(*a*)–(*f*) are views respectively showing the waveforms of a micro-vibration pulse and an ejection pulse.

DETAILED DESCRIPTION OF THE PREFERRED EMBODIMENT

Using the drawings, an embodiment of the present invention will be described below.

Figure 1:
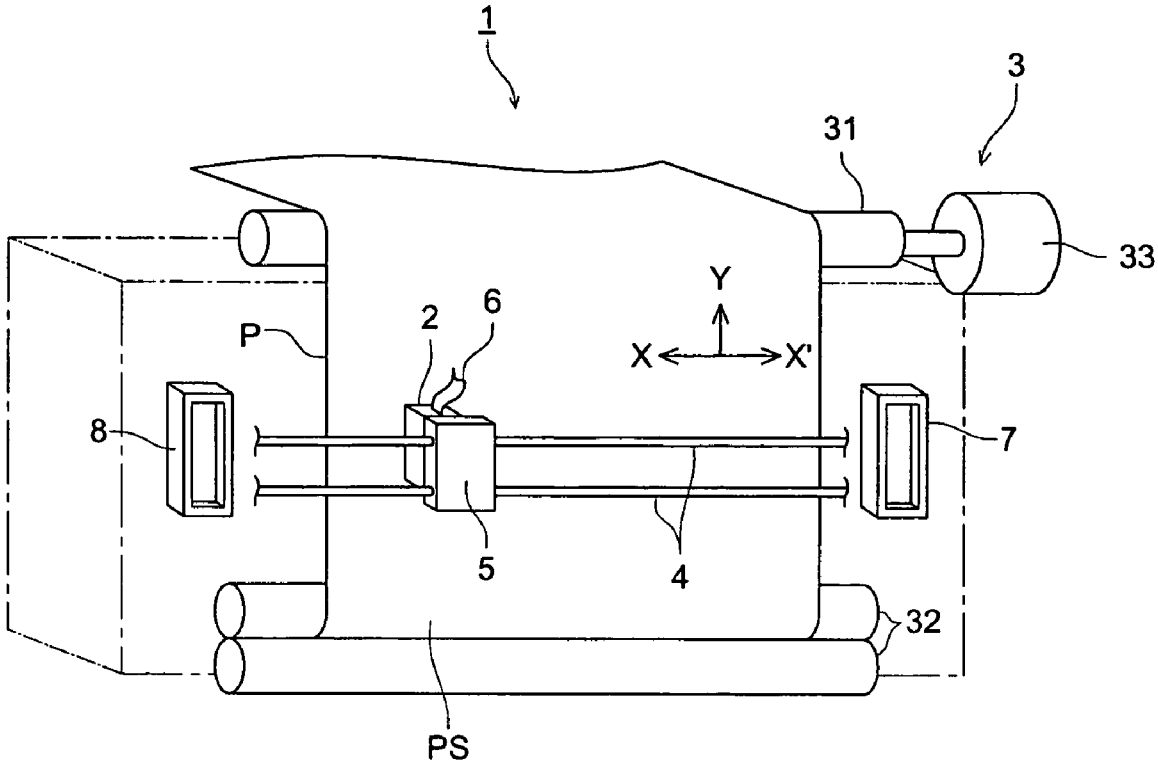
FIG. 1 is a view showing an outline structure of an inkjet recording apparatus.

FIG. 1 is a view showing an outline structure of an inkjet recording apparatus for which a droplet ejection apparatus according to the present invention is applied. In an inkjet recording apparatus 1, it is structured in such a manner that a recording medium P is nipped by a conveying roller pair 32 of a conveying mechanism 3, and further, is conveyed in a Y direction in the view by a conveying roller 31 rotated by a conveying motor 33.

Between the conveying roller 31 and the conveying roller pair 32, a recording head 2 is provided so that it is opposite to a recording surface PS of the recording medium P. This recording head 2 is arranged in such a manner that a nozzle surface side is opposite to the recording surface PS of the recording medium P, and mounted on a carriage 5 provided so that it can reciprocally move along X–X' direction (primary scanning direction) shown in the view, which is almost perpendicular to the conveying direction (sub-scanning direction) of the recording medium P by a drive means, not shown, along a guide rail 4 which is installed across the width direction of the recording medium P, and through a flexible cable 6, it is electrically connected to a drive signal generating section 100 (refer to FIG. 3) in which a circuit to generate an ejection pulse or micro-vibration pulse which will be described later, is provided.

Such a recording head 2 moves the recording surface PS of the recording medium P accompanied to the movement of the carriage 5, in X–X' direction, shown in a view, and in this movement process, by ejecting an ink droplet, a desired inkjet image is recorded.

Hereupon, in a view, numeral 7 is an ink receiving unit provided at a position such as a home position, where the recording head 2 waits at the period of no-recording. When the recording head 2 is at this waiting position, after the ink whose viscosity is increased, is micro-vibrated and its viscosity is decreased, it is conducted that a small amount of the ink droplet is discarded to this ink receiving unit 7. When the recording head 2 stops its operation for a long period of time at this waiting position, it is not shown, but by putting a cap on the nozzle surface of the recording head 2, it is protected. Further, numeral 8 is an ink receiver provided at an opposite position to the ink receiving unit 7 with the recording medium P between them, and in cases where recording is conducted in reciprocal both directions, when the head is switched from a going movement to a returning movement, the discarded ink droplet is received in the same manner as an above description.

Figure 2:
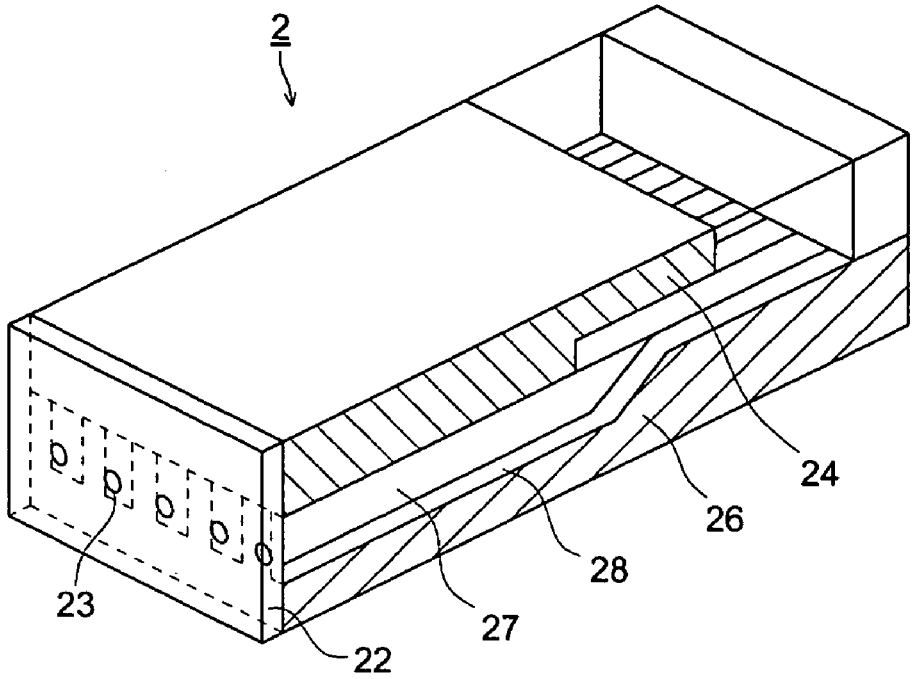
FIG. 2(*a*) is a general viewed perspective view showing an example of a recording head, and FIG. 2(*b*) is a sectional view of the head.
Figure 2:
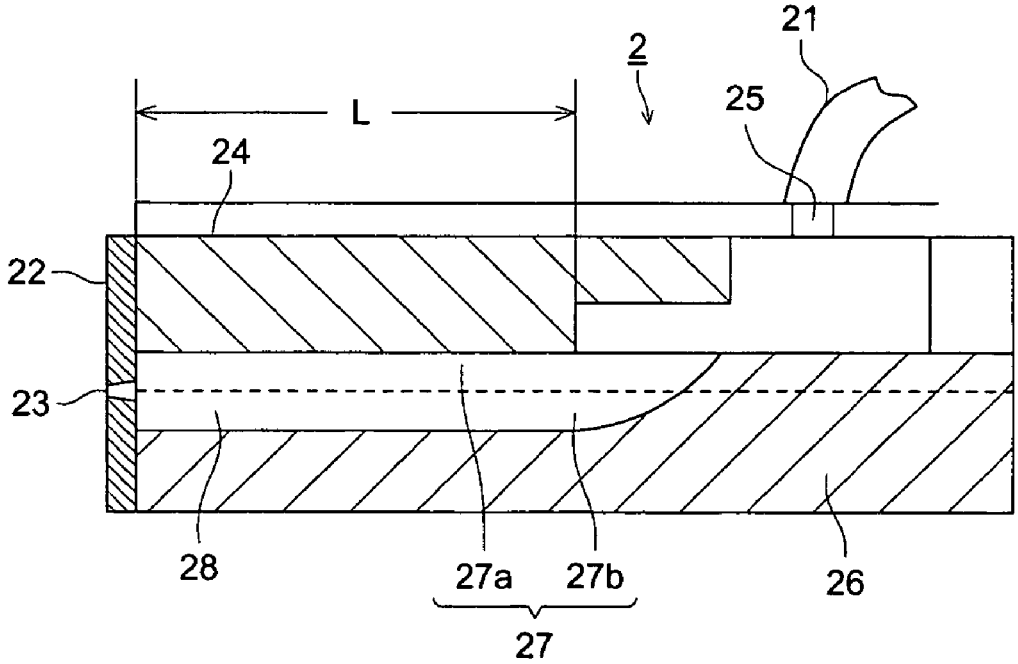
Figure 3:
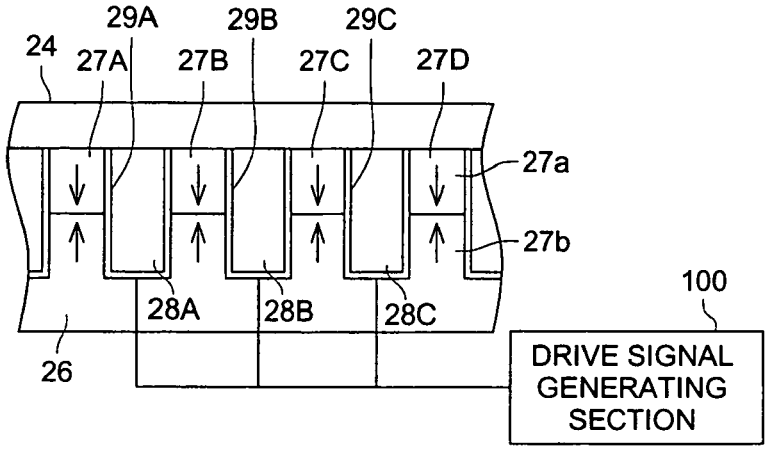
FIGS. 3(*a*)–(*c*) are views showing a motion at the time of the ink ejection of a recording head.
Figure 3:
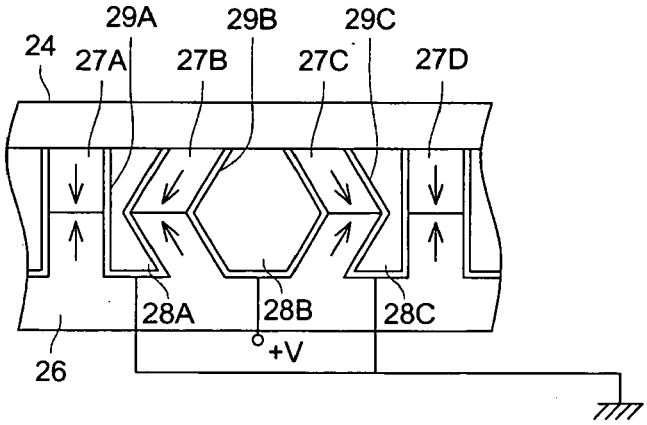
Figure 3:
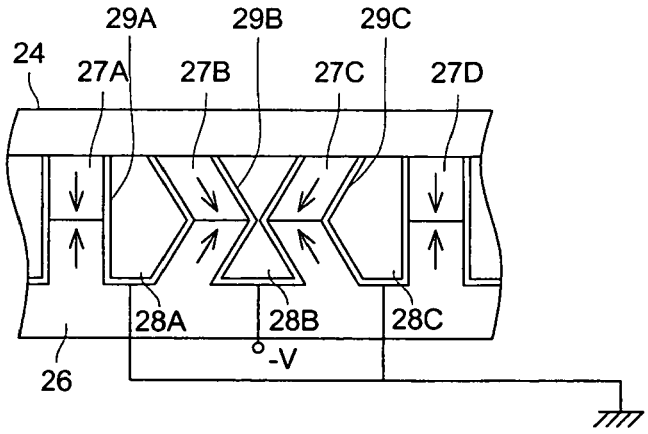

FIG. 2 and FIG. 3 are views showing an example of the recording head 2, and FIG. 2(*a*) is a general viewed perspective view, (*b*) is a sectional view, and FIG. 3 is a view showing the movement at the time of the ink ejection. In the same view, numeral 21 is an ink tube, numeral 22 is a nozzle forming member, numeral 23 is a nozzle, numeral 24 is a cover plate, numeral 25 is an ink inlet, numeral 26 is a substrate, and numeral 27 is a partition wall. Then, a channel 28 is formed of the partition wall 27, cover plate 24, and substrate 26.

The recording head 2 shows herein, as shown in FIG. 3, between the cover plate 24 and the substrate 26, a recording head of a shearing mode (shear mode) type in which many channels 28 separated by a plurality of partition walls 27A, 27B, 27C formed of a piezoelectric material such as a PZT which is the electric-mechanical conversion element, are arranged in parallel. In FIG. 3, 3 channels (28A, 28B, 28C) which are a part of many channels 28, are shown. An end of the channel 28 (hereinafter, there is sometimes a case where this is called a nozzle end) is connected to a nozzle 23 formed of the nozzle forming member 22, and the other end (hereinafter, there is sometimes a case where this is called a manifold end) is, through the ink inlet 25, connected to an ink tank, not shown, by the ink tube 21. Then, on the partition wall 27 surface in each channel 28, electrodes 29A, 29B, and 29C connected over from the above portion of both partition walls 27 to the bottom surface of the substrate 26, are formed with close contact, and each of electrodes 29A, 29B, and 29C is connected to a drive signal generating section 100. And, this drive signal generating section 100 includes a drive signal generating section, which generates a series of drive signals including plural drive pulses for every cycle of pixels, and includes a drive pulse selecting circuit, which select a drive pulse corresponding to a print datum of each pixel among the drive signals supplied for each channel from the aforesaid drive signal generating section. This drive pulse includes a micro-vibration pulse and an ejection pulse. And, this drive signal generating section 100 generates a micro-vibration pulse and an ejection pulse to drive the separation wall 27 which functions as an electric-mechanical conversion element.

Here, the drive signal generating circuit corresponds to the drive signal generator in claims of the invention, and the drive pulse selecting circuit corresponds to the drive pulse selector in the claims.

Each of partition walls 27 is structured, as shown by an arrow in FIG. 3, by two piezoelectric materials 27*a* and 27*b* whose polarization directions are different, however, the piezoelectric material may also be, for example, only a portion of a sign 27*a*, or it may be allowed when it is at least in a portion of the partition wall 27.

When the ejection pulse is applied on electrodes 29A, 29B, and 29C which are formed with close contact on each partition wall 27 surface, by the control of the drive signal generating section 100, the ink droplet is ejected from the nozzle 23, by the motion illustrated below. Hereupon, in FIG. 3, the nozzle is neglected.

Initially, when the ejection pulse is not applied on any one of electrodes 29A, 29B, and 29C, any one of partition walls 27A, 27B, and 27C is not deformed, but in the situation shown in FIG. 3(*a*), when electrodes 29A and 29C are electrically grounded and the ejection pulse is applied on the electrode 29B, the electric field in the perpendicular direction to the polarization direction of the piezoelectric material constituting partition walls 27B and 27C is generated, and together with both partition walls 27B and 27C, the shearing deformation is respectively produced in the contact surface of partition walls 27*a* and 27*b*, and as shown in FIG. 3(*b*), partition walls 27B and 27C are deformed toward the outside with each other, the volume of the channel 28B is expanded, the negative pressure is produced in the channel 28B, and the ink is flowed in (Draw).

Further, when the electric potential is returned to 0 from this situation, partition walls 27B and 27C are returned from the expansion position shown in FIG. 3(*b*) to the neutral position shown in FIG. 3(*a*), and the high pressure is put on the ink in the channel 28B (Release). Next, as shown in FIG. 3(*c*), when the ejection pulse is applied on in such a manner that partition walls 27B and 27C are deformed in a reversal direction to each other, and the volume of the channel 28B is reduced, the positive pressure is generated in the channel 28B (Reinforce). Thereby, the ink meniscus in the nozzle which is portion of ink filling ink channel 28, is changed in the direction in which it is extruded from the nozzle. When this positive pressure is increased so much as the ink droplet is ejected from the nozzle, the ink droplet is ejected from the nozzle. Also each of other channels operates in the same manner as the above description by the applying of the ejection pulse. Such an ejection method is called a DRR (Draw-Release-Reinforce) drive method, and is a typical drive method of the recording head of the shear mode type.

In the case where the recording head 2 having a plurality of channels 28 separated by the partition wall 27 at least whose one portion is structured by the piezoelectric material is driven as described above, when the partition wall of a channel is moved so as to conduct the ejection, because adjacent channel is influenced. Normally, in a plurality of channels 28, it is made to be one group by combining the channels 28, which are separated each other with at least one other channel 28 between them, and the plurality of channels 28 is divided into more than 2 groups, and is driven and controlled in such a manner that the ink ejection motion is successively conducted by time division for each groups. For example, when all channels 28 are driven and a solid image is outputted, so-called three cycle ejection method is carried out, by which the channels 28 are selected every 3 channels to form three groups, and the ink droplet is ejected with being divided into 3 phases.

Figure 5:
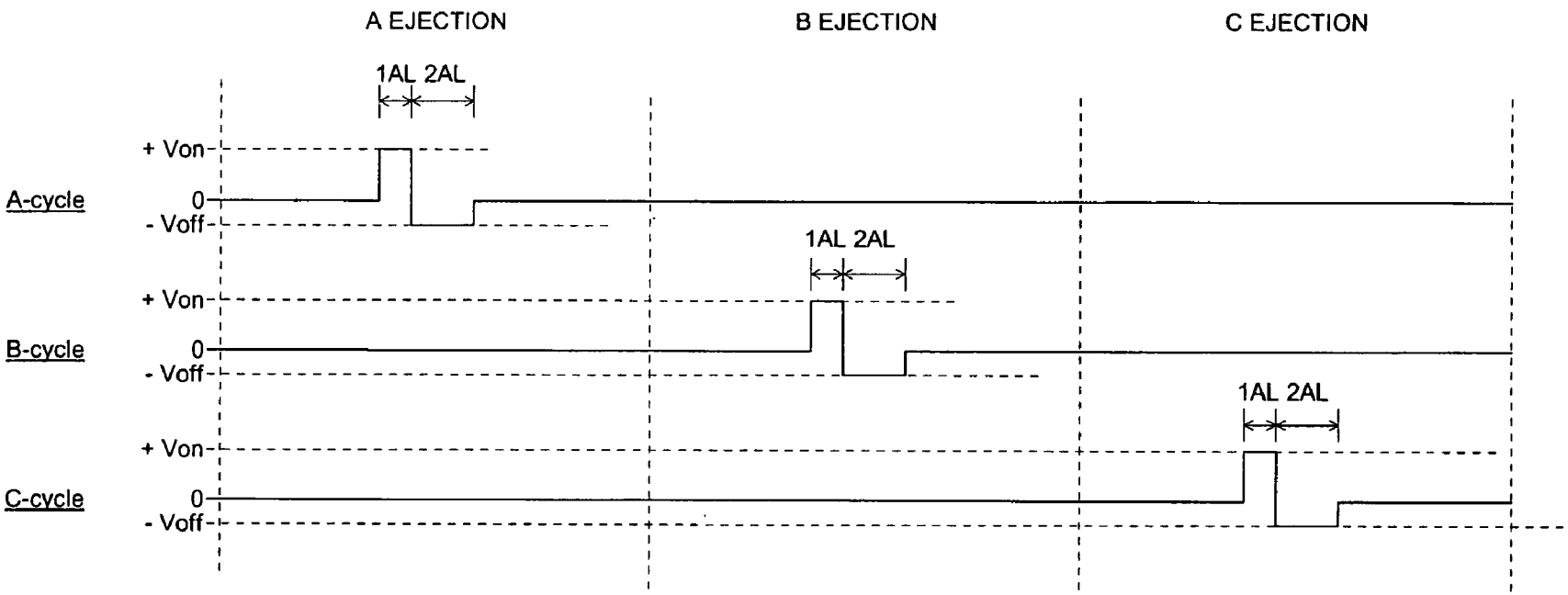
FIG. 5 is a timing chart of a pulse waveform applied on a channel of each group of A, B, and C.

By using FIG. 4(*a*)–(*c*), such a three cycle ejection motion will be further described below. In the example shown in FIG. 4, it will be described as that, in the recording head, the channel is structured by 9 channels 28 of A1, B1, C1, A2, B2, C2, A3, B3, and C3. Further, a timing chart of the pulse waveform applied on the channel 28 of each of groups of A, B, and C in this case, is shown in FIG. 5.

At the time of the ink ejection, initially, the voltage is applied on the electrode of each channel of group A (A1, A2, A3), and the electrodes of both adjacent channels are electrically grounded. For example, when the ejection pulse of the positive voltage of 1 AL width is applied on the channel of group A, the partition wall of the channel of the group A wanted to be ejected, is deformed outward, and the negative pressure is generated in the channel 28. By this negative pressure, the ink is flowed in the channel 28 of the group A from the ink tank. (Draw).

When this situation is kept for 1 AL, because the pressure is reversed to the positive pressure, when the electrode is electrically grounded at this timing, the deformation of the partition wall is restored to the initial condition, and the high pressure is applied on the ink in the channel 28 of group A (Release). Further, when at the same timing, the negative voltage is applied on the electrode of each channel of group A, the partition wall deforms inside, and the further high pressure is applied on the ink (Reinforce) and the ink column is extruded from the nozzle. After 1 AL, the pressure is reversed and the inside of the channel 28 becomes negative pressure, and when further 1 AL passes, because the pressure in channel 28 is reversed and becomes the positive pressure, when the electrode is electrically grounded at this timing, the deformation of the partition wall is restored to the initial condition, and the residual pressure wave can be cancelled out.

Subsequently, the same motion as above description is conducted on each channel 28 of group B (B1, B2, B3), and further successively onto each channel 28 of group C (C1, C2, C3).

Hereupon, the AL (Acoustic Length) is, as described above, ½ of the acoustic resonance period of the channel. This AL is found as the pulse width in which the flying speed of the ink droplet becomes maximum, when the voltage pulse of rectangular wave is applied on the partition wall 27 which is the electric-mechanical conversion element, the speed of the ejected ink droplet being measured, the voltage value of the rectangular wave being made constant, and the pulse width of the rectangular wave being made to be changed. Further, the pulse is a rectangular wave having a prescribed voltage height, and the pulse width is defined, when the 0 voltage is 0% and the voltage height is 100%, as the time period between at 10% rise from 0 voltage in rising edge and at 10% fall from the voltage height in decaying edge. Further, the rectangular wave herein indicates a waveform in which both of the rise time between 10% and 90% of the voltage, and the fall time between them are within ½ of the AL, and preferably, within ¼.

Figure 6:
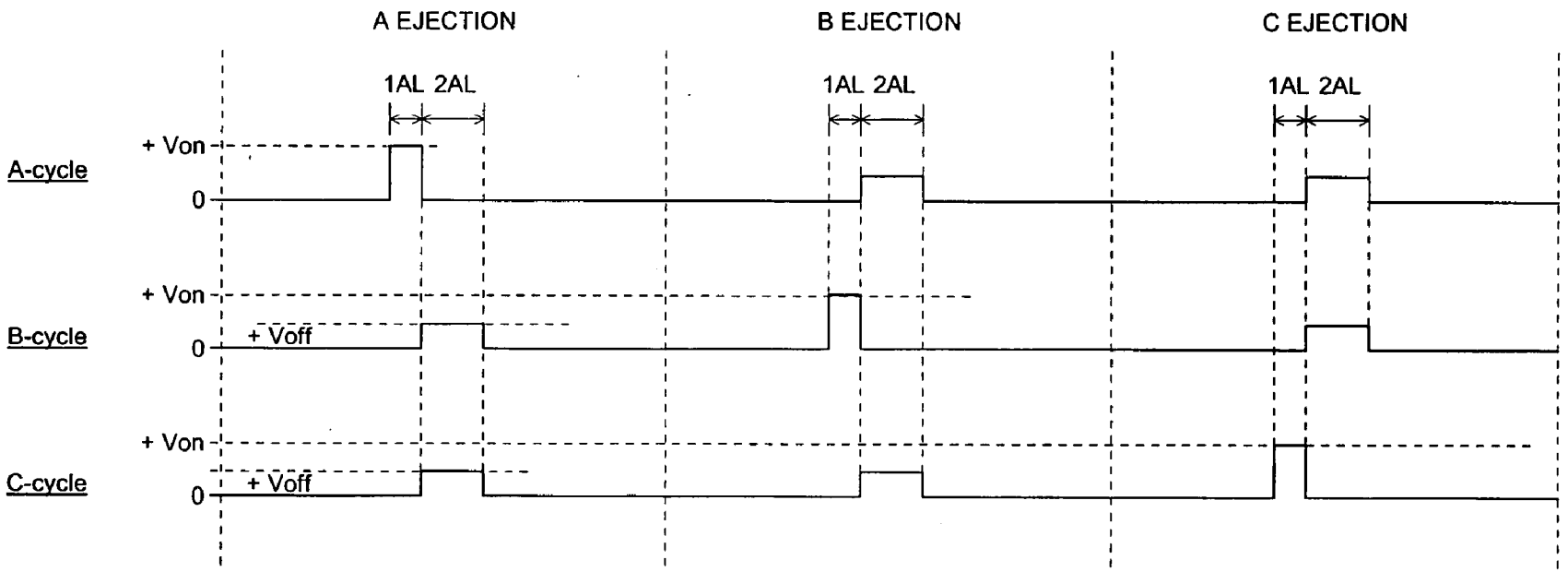
FIG. 6 is a timing chart of the pulse waveform in the case where only the positive voltage is used.

In the inkjet recording head of such a shear mode type, because the deformation of the partition wall is caused by the difference of the voltage applied on the electrodes provided on both sides of the wall, in place of that the negative voltage is applied on the electrode of the channel to conduct the ink ejection, as shown in FIG. 6, even when the electrode of the channel to conduct the ink ejection is electrically grounded, and the positive voltage is applied on the electrodes of its both adjacent channels, the same motion can be conducted. According to this latter method, because it can be driven by only the positive voltage, it is a preferable mode.

Next, by using FIG. 7 and FIG. 8, in the recording head 2 of such a shear mode type, the motion to give the micro-vibration to the meniscus will be described. Also herein, in the same manner as described above, a head which conducts 3 cycle ejection motion will be described. Further, herein, it is defined that only the positive voltage is used for the drive waveform voltage, and the ejection is made in the order of group A→group B→group C. In this description, as for the drive signal, an example is explained which consists of each one type of micro-vibration pulse and ejection pulse.

In the present invention, the micro-vibration pulse to micro-vibrate in the degree in which the ink droplet is not ejected from the nozzle, is generated in the drive signal generating section 100 shown in FIG. 3, in the same manner as the case where the ejection pulse is applied. The micro-vibration pulse in the present invention is formed of the rectangular wave, and is characterized in that it includes at least one of the rectangular wave whose pulse width is (2n) AL (n is an integer not smaller than 1).

In the present invention, when the rectangular wave is used for the micro-vibration pulse, the efficiency in which the meniscus is micro-vibrated, is better as compared to a method by which the trapezoidal wave is used, and it can be micro-vibrated by the low drive voltage, and further, there is an effect in which the drive circuit can be designed by a simple digital circuit.

Figure 7:
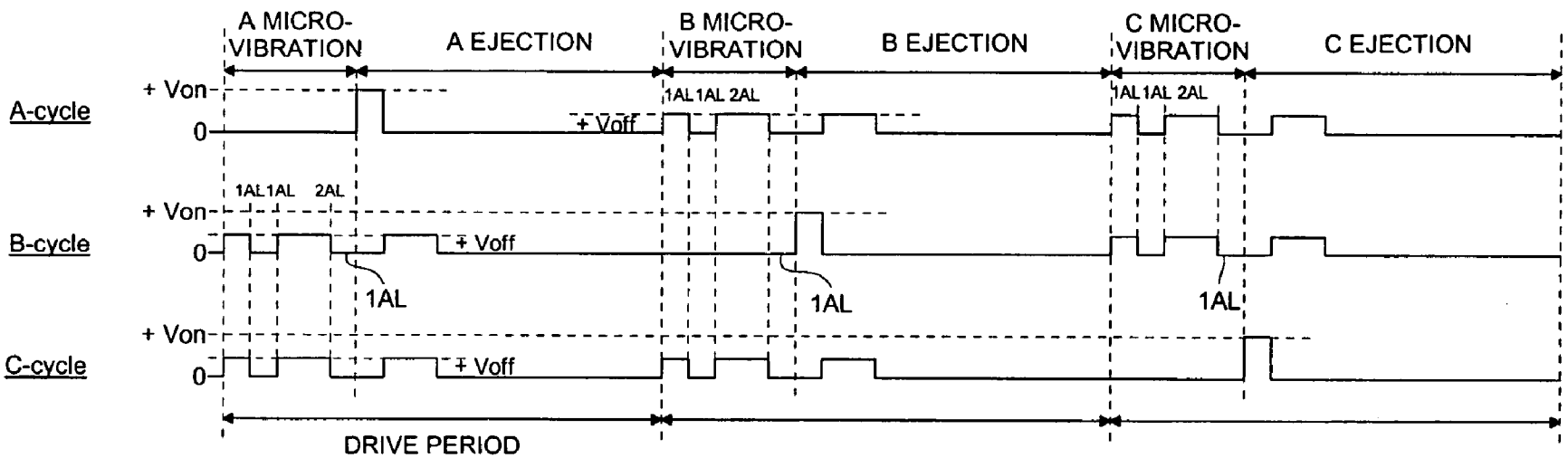
FIG. 7 is a timing chart of the pulse waveform applied on a channel of each of groups of A, B, and C at the time of meniscus micro-vibration to all print pixels.

For example, in the example shown in FIG. 7, in an image recording region, initially, the electrode of the channel of group A is electrically grounded, and the micro-vibration pulse formed of the rectangular wave of the positive voltage of 1 AL width and the micro-vibration pulse formed of the rectangular wave of the positive voltage of 2 AL width are applied with 1 AL interval on electrodes of channels of group B and group C. Thereby, on the meniscus in the nozzle of the channel of group A, the micro-vibration is applied so that the ink droplet is made to be extruded in a degree in which the ink droplet is not ejected from the nozzle, and in each of channels of group B and group C, only the partition wall of one side is deformed, and the micro-vibration of half of the intensity for the channel of group A is given.

Successively, when the ejection pulse of the positive voltage of 1 AL width is given to the channel of group A, and successively, the ejection pulses of the positive voltage of 2 AL width are respectively given to channels of group B and group C, the ink is ejected from the channel of group A by the above-described DRR drive method, and the pixel is recorded. When the multi-droplets ejection is conducted, this 2 kinds of pulses are repeated for the number of droplets wanted to be ejected.

In the same manner also in the case where the ejection from the channel of the group A is completed, and the ejection is successively conducted from the channel of the group B, after the electrode of the channel of the group B is electrically grounded, the micro-vibration pulse of the positive voltage of 1 AL width and the micro-vibration pulse of the positive voltage of 2 AL width are respectively applied with 1 AL interval on electrodes of channels of the group A and the group C, and the meniscus is micro-vibrated. After that, the ejection pulse of the positive voltage of 1 AL width is given to the electrode of channel of group B, and when successively the ejection pulse of the positive voltage of 2 AL width is given to electrodes of channels of group A and group C, the ejection from the channel of group B is conducted, and the pixel is recorded. The applying of the micro-vibration pulse and the ejection of droplet of the channel of group C are also conducted in the same manner.

Next, the case where any one of channels of group A, group B, and group C does not conduct the ejection, and the micro-vibration is given to the meniscus in the order of group A→group B→group C, will be described by using FIG. 8.

In the same manner as in FIG. 7, initially, the electrode of the channel of group A is electrically grounded, and when the micro-vibration pulse of the positive voltage of 1 AL width and the micro-vibration pulse of the positive voltage of 2 AL width are applied on the electrodes of the groups B and C with the interval of 1 AL, the micro-vibration is given to the meniscus in the nozzle of the channel of the group A. Successively, when the pulse of the positive voltage of 2 AL width is given to all channels of groups A, B, and C, because the partition wall is not displaced, the ink ejection is not also conducted.

Figure 9:
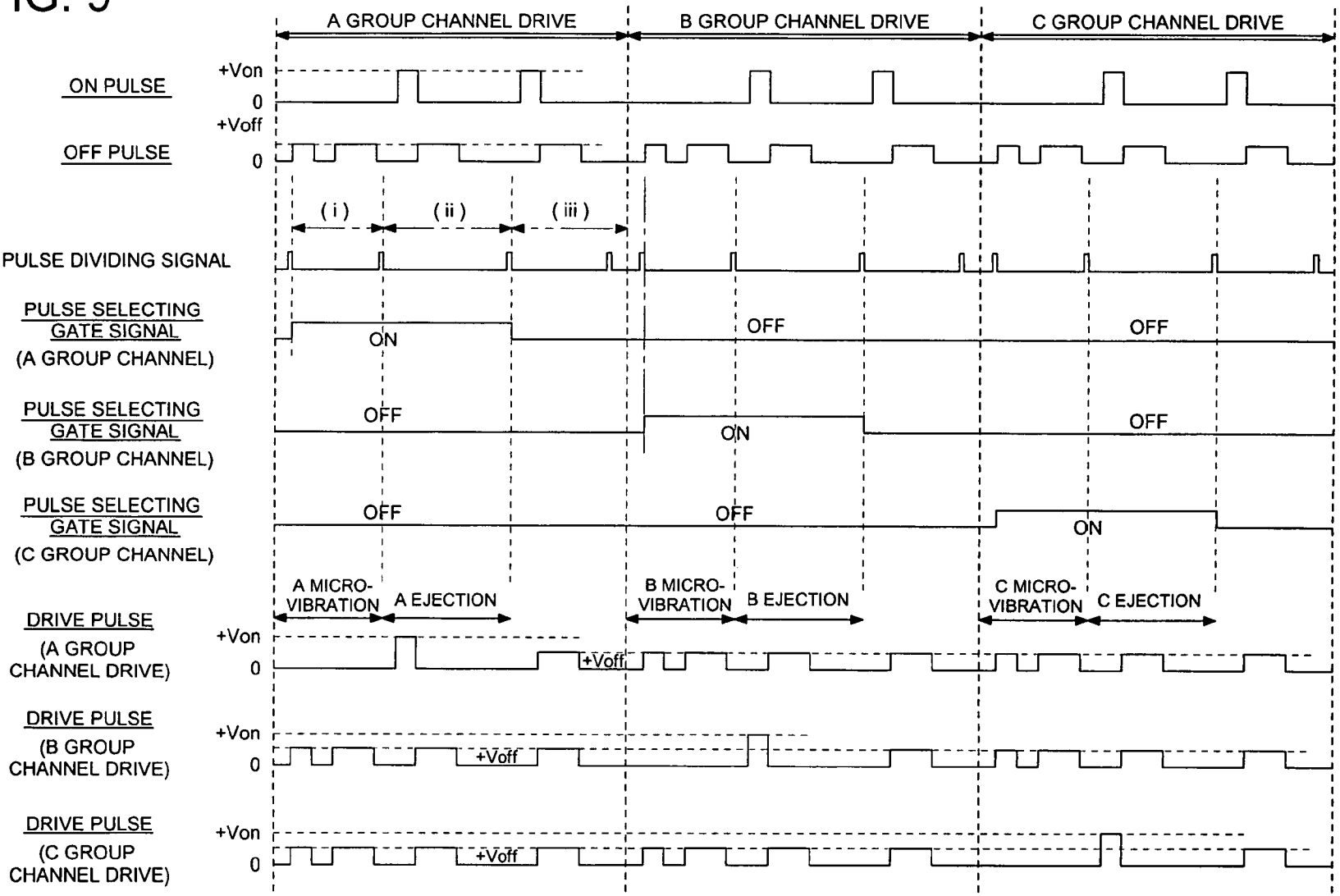
FIG. 9 is a timing chart showing an example where a micro-vibration pulse and an ejection pulse is selectively applied to each channel of group A, group B and group C.

Next, the method of selecting the drive pulse for each pixel is explained by using FIG. 9. In FIG. 9, ON pulse and OFF pulse represent two kinds of drive signal generated by the drive signal generating section. This drive signal is formed of three kinds of pulses; a micro-vibration pulse (i) and two ejection pulses (ii) and (iii), and this signal is an example capable of multi-droplets ejection of two droplets. Each of the ON pulse and the OFF pulse are supplied to the drive pulse selecting circuit of each channel, and are selectively supplied to the electrode of each channels by the control of pulse selecting gate signal in accordance with the imaging data for each channels. The drive pulse selecting circuit supplies the ON pulse to the electrode when the pulse selecting gate signal is in High state, and supplies OFF pulse to the electrode when the pulse selecting gate signal is in Low state. FIG. 9 describes shows the modes of one cycle period for each of the group A, group B and group C, however, hereinafter an example of channel drive timing for group A is explained. For each of the period before applying of micro-vibration pulse, the period after the applying of the micro-vibration pulse until the applying of the ejection pulse and the period after the applying of the ejection pulse, the pulse dividing signal is applied. According to the supply of an imaging datum for a pixel, the pulse selecting gate signal synchronized with the pulse dividing signal becomes ON state. During the period when the pulse selecting gate signal corresponding to the group A channels is ON, (the period of (i) to (ii) in FIG. 9) ON pulse of the drive waveform is applied to the group A channels, and in this period, since the pulse selecting gate signals corresponding to the group B and group C are OFF, the OFF pulses are applied to the group B channels and the group C channels, and the separation walls in both sides of the each of group A channels are deformed. Further in the period (iii) of FIG. 9, since each of the pulse selecting gate signals of group A, group B and group c is OFF, OFF pulse is applied to each of channel electrodes in group A, group B and group C, and none of the separation walls is deformed. The channel drive timing for group B and group C operate in the same manner as for group A.

As described above, when the micro-vibration pulse including the rectangular wave is applied always, also on the printing pixel (in the case of FIG. 7) and no-printing pixel (in the case of FIG. 8), an increase of the viscosity of the ink in the vicinity of the nozzle opening can be effectively suppressed.

Particularly, as shown in FIG. 7, when the micro-vibration pulse is made to be applied on all printing pixels in the image recording region before the ejection pulse, because the micro-vibration is always given to the meniscus just before each pixel to be printed, the recording of the high quality image can conducted by always stable ink ejection, and further more, in the continuous ejection, because the residual pressure when the ejection is conducted before, can be cancelled by the applying of the micro-vibration pulse, the image recording of higher quality can be conducted.

Hereupon, the phrase "before the ejection pulse", indicates, in the ejection of the ink droplet after the micro-vibration, the time in the range in which the effect is seen in the improvement of the decapping characteristic.

In this manner, when the micro-vibration pulse is applied on all print pixels in the image recording region, it is preferable that the maximum extrusive amount of the meniscus which is micro-vibrated in the degree that the ink droplet is not ejected from the surface of the nozzle, is not larger than nozzle radius. When the extrusive amount by the meniscus micro-vibration is large, the meniscus can not return up to the timing of the next ink ejection, and the stable ejection becomes difficult, however, when the extrusive amount of the meniscus in this case is suppressed under the nozzle radius, even just after the meniscus micro-vibration, the stable ejection can be conducted.

Figure 12:
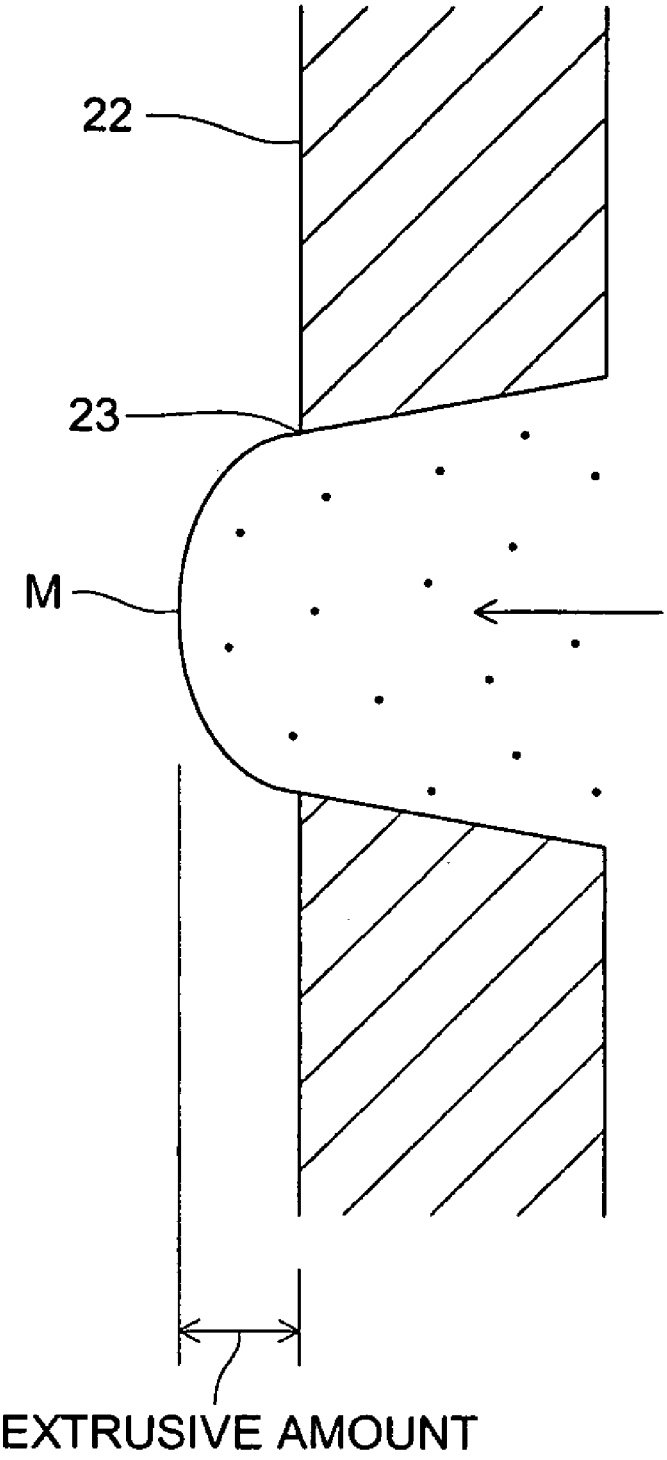
FIG. 12 is a view explaining an extrusive amount of the meniscus from the surface of a nozzle.

Hereupon, the phrase "maximum extrusive amount" is the maximum value of the extrusive amount of the meniscus from the surface of the nozzle in one time of the meniscus extrusive motion. The extrusive amount of the meniscus from the nozzle 23 can be measured by the strobe-synchronization, for example, by using the digital microscope [VH-6300] produced by KEYENCE Co. The extrusive amount is, as shown in FIG. 12, a value in which the protrusion amount from the nozzle surface in about central portion of the nozzle 23 of the meniscus M, is measured in about perpendicular direction to the nozzle forming member 22.

Further, the shape of the opening of the nozzle 23 is not limited to the true circle, but there are various shapes such as the ellipse shape, and herein, the nozzle radius is ½ of the longest diameter on the surface (the surface of the nozzle forming member 22) side of the nozzle 23.

Figure 8:
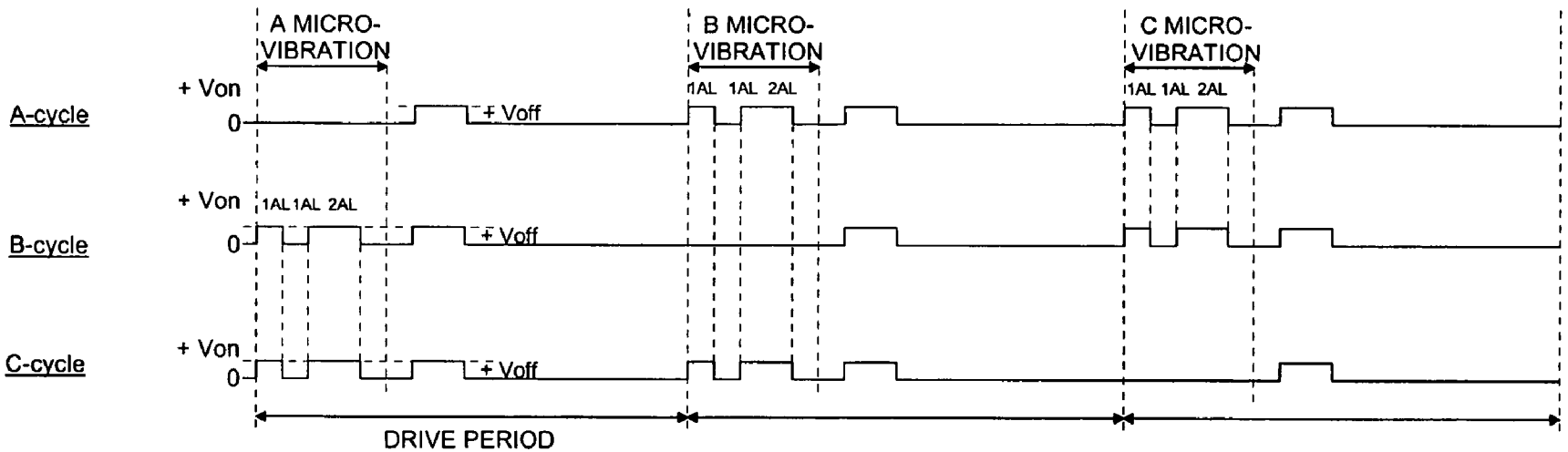
FIG. 8 is a timing chart of the pulse waveform applied on a channel of each of groups of A, B, and C at the time of meniscus micro-vibration to no-print pixels.

In the present invention, it is well when at least one of the rectangular wave whose pulse width is an even number AL width, that is, (2n) AL, is included in the micro-vibration pulse, and as shown in FIG. 7 and FIG. 8, when the rectangular wave whose pulse width is (2n) AL is made to be at least included in the last of a series of the micro-vibration pulses, because there is an effect that the residual pressure wave by the micro-vibration pulse is cancelled, it is preferable in the case where the high frequency drive by which the ejection is conducted just after the meniscus is micro-vibrated, is conducted.

Further, herein, because the vibration is made conducted again by the micro-vibration pulse of even number AL width after 1 AL after the meniscus is largely vibrated by the micro-vibration pulse of the odd number AL width, and after the remained pressure wave is cancelled, the ejection is conducted, the decapping characteristic is largely improved and stable ejection can be attained.

Hereupon, when the rectangular wave whose pulse width is (2n) AL, is applied on the last of the micro-vibration pulse, as shown in FIG. 7, it is preferable that the ejection pulse is applied on after 1 AL of that. The reason is that since the cancellation of the residual pressure wave is not perfect, if the ejection pulse is applied after 1 AL from the micro-vibration, the residual pressure wave and the pressure wave caused by the ejection pulse become in opposite phase with each other, and the influence of the residual pressure wave to the ejection pulse can be minimized.

In the above example, it is made that n=1, and one micro-vibration pulse whose pulse width is 2 AL is included, however, n may be an integer not smaller than 2.

In the example shown in FIG. 7–FIG. 9, the micro-vibration pulse includes the rectangular wave with pulse width of 1 AL and 2 AL, since the meniscus can be effectively micro-vibrated in a short time in these cases, and since especially in cases where the decapping phenomenon is intense and in a mode of high frequency drive in which ink ejection is conducted immediately after the micro-vibration, the mode of FIG. 7–9 can generate micro-vibration of meniscuses at all of the pixels without large decrease of image recording rate, this mode is a preferable embodiment. Further, since the mode in which the micro-vibration pulse includes only rectangular pulses with pulse width of 2 AL can generate micro-vibration of meniscuses for all of each pixel in a minimum cycle period, the mode is especially preferable in the case of attaining high-speed printing.

Furthermore, when more than 2 rectangular waves whose pulse width is (2n) AL are included in the micro-vibration pulse, n may be different respectively, and further, in the case where the micro-vibration pulse has 2 and more micro-vibration pulses which includes at least one rectangular wave whose pulse width is (2n) AL, when the interval between former rectangular wave and the latter rectangular wave is an integer times of AL, it is preferable because the meniscus can be effectively micro-vibrated.

In the example shown in FIGS. 5, 6, 7, and 9, the ejection pulse includes the first pulse of rectangular wave which restore the channel to the original state 1 AL after the volume of the channel is expanded, and the second pulse of rectangular wave which, successively to the first pulse, reduces the volume of the channel and after 2 AL restores to the original state. In this case, it is preferable that the voltage of the first pulse Von is greater than the voltage of the second pulse Voff, and particularly near the range of satisfying Von/Voff=2/1 is preferable. To set Von greater than Voff is preferable since this has an effect of accelerating the ink supply into the channel especially in cases of where the liquid to be ejected has high viscosity. The micro-vibration pulse consist of only the rectangular wave which restore the volume of the channel after the reduction of the volume and the pulse voltage of the micro-pulse is set to be the same voltage as the second pulse voltage Voff of the aforesaid ejection pulse. This is preferable because the number of voltages of power supply can be lessened in drive signal generating section 100 for generating the ejecting pulse and the micro-vibration pulse, and manufacturing cost of the circuit can be decreased. Further by setting the voltage of the micro-vibration pulse as the lower voltage of Voff, excessive intension of the micro-vibration can be prevented and the micro-vibration in the level of not ejecting an ink droplet can be effectively generated.

Incidentally, the ejection pulse is not restricted to that used in the embodiment, but may be a drive pulse including a pulse which can expand the volume of the channel and after a certain time restore or reduce the volume of the channel to eject the ink droplet.

The electric-mechanical conversion element in the present invention is, as described above, not limited to one formed of the piezoelectric material which forms the partition wall between adjacent channels and which is deformed in the shearing mode by applying the electric field, but when it is one which gives the recording head the function by which the volume of the channel is changed, any structure may be allowed, however, as shown in the present embodiment, when it is structured by the piezoelectric material which is deformed in the shearing mode, it is preferable because the above-described rectangular wave can be more effectively used, the drive voltage is lowered, and the more effective drive can be conducted.

Further, in the above description, an application of the inkjet recording apparatus is shown as an example of the droplet ejection apparatus, and an inkjet recording head is shown as an example of the droplet ejection head, however, the present invention is not limited to this, but it can be widely applied to the droplet ejection apparatus and to the drive method of droplet ejection head by which the liquid in the channel, whose viscosity is easily increased, is made to be a droplet and is ejected from the nozzle.

EXAMPLE (The Evaluation 1 of the Ejection Stability)

Each channel of the recording head (number of nozzles: 256, nozzle diameter is 23 μm) of the shear mode type shown in FIG. 2, is divided into 3 groups as shown in FIG. 4, and by using the micro-vibration pulse and ejection pulse shown in FIGS. 10(*a*)–(*f*), 3 cycle drive is conducted under the following condition. The result in which the ejection stability at this time is measured by the following method, is shown in Table 1.

Condition

Head: AL=2.0 μs

Ink: aqueous ink, (viscosity: 5.5 mPa·s, surface tension: 41 mN/m at 25° C.)

Drive voltage ratio: Von/Voff=2/1

Drive period: 33 μs

Measuring Method of the Ejection Stability

In respective micro-vibration pulse applying conditions, by changing the voltage Von, Voff, the flying speed of the ink droplet is increased, and the flying situation of the ink droplet is observed. The upper limit of the flying speed in which the curving of the ejection direction and the spattering of the satellite are not caused, is defined as the upper limit of the stable ejection speed.

The Evaluation Standard of the Ejection Stability

A: 8 m/s≦the upper limit of the stable flying speed

B: 6 m/s≦the upper limit of the stable flying speed<8 m/s

C: the upper limit of the stable flying speed<6 m/s

Measuring Method of the Decapping Characteristic

In each micro-vibration pulse applying condition, the drive voltage is fixed at the value where the flying speed of the ink droplet becomes 6 m/s in regular drive of the ejection head (Von/Voff=2/1), and the change of initial flying speed at the time of ink ejection is observed while increasing the ejection interval. It is recognized that the smaller the change of initial flying speed, the greater the effect of improvement in the decapping characteristics.

TABLE 1

| | FIG. 10 | Micro-vibration pulse applying condition | The number of micro-vibration pulse applying | Ejection stability | If there is an effect of improvement in the decapping characteristic |
|---|---|---|---|---|---|
| Comparative example 1 | (a) | Not applied | 0 | A | No |
| Comparative example 2 | (b) | 1 AL width Voff | 1 | B | Yes |
| Example 1 | (c) | 2 AL width Voff | 1 | A | Yes |
| Comparative example 3 | (d) | 3 AL width Voff | 1 | B | Yes |
| Comparative example 4 | (e) | 1 AL width Voff + 1 AL width 0 + 1 AL width Voff | 2 | C | Evaluation impossible |
| Example 2 | (f) | 1 AL width Voff + 1 AL width 0 + 2 AL width Voff | 2 | A | Yes (great effect) |

As shown in Table 1, when the micro-vibration pulse formed of only the rectangular wave having a pulse width of AL multiplied with odd number is applied the ejection stability is not sufficient, however when the micro-vibration pulse including the rectangular wave having a pulse width of AL multiplied with even number is applied it is possible to conduct a stable ejection even just after the meniscus is micro-vibrated.

(Evaluation of the Decapping Characteristic)

Each channel of the recording head of the same shear mode type as the case of the evaluation 1 of the ejection stability is divided into 3 groups, and by using the micro-vibration pulse and the ejection pulse shown in FIG. 10, 3 cycle drive is conducted under the following condition, and the improvement effect of the decapping characteristic under the low temperature and low humidity circumstance and the drive voltage are estimated.

Figure 11:
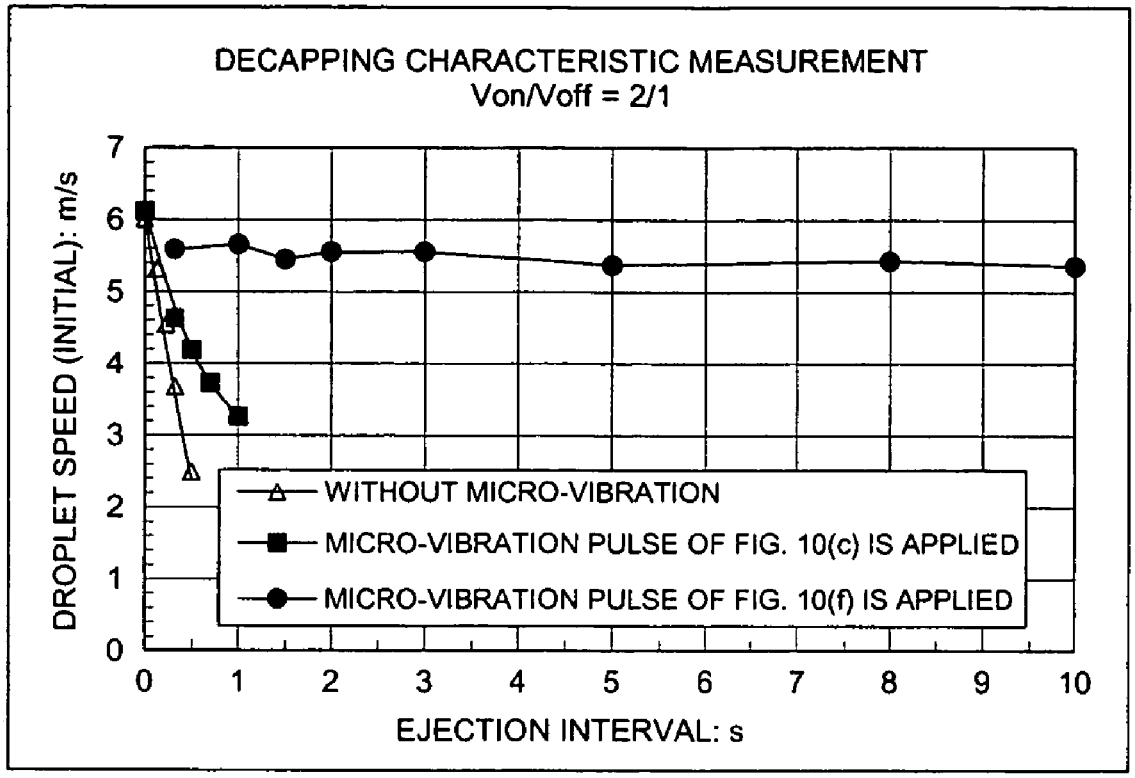
FIG. 11 is a graph showing a measurement result of the decapping characteristic.

The decapping characteristic is measured for an arbitrary 1 nozzle by the following method. That result is shown in FIG. 11 and Table 2.

Condition

Head: AL=2.0 μs

Ink: Aqueous pigment ink (viscosity: 11 mPa·s, surface tension: 34 mN/m at 11° C.)

Drive voltage ratio: Von/Voff=2/1

Drive period: 33 μs

Circumstance: 11° C., 35% RH

Measuring Method of the Decapping Characteristic

About the condition in which the micro-vibration pulse is not applied on the no-print pixel and print pixel, and the condition in which the micro-vibration pulse shown in FIG. 10(*c*) and FIG. 10(*f*) is applied on all pixels, the flying speed of the 20-th ejection is measured, while the drive voltage is changed, (fixed to Von/Voff=2/1). The drive voltage (Von) when the flying speed is 6 m/s is shown in Table 2.

The drive voltage is fixed to the voltage whose flying speed at the time of this normal drive is 6 m/s, and while the ejection interval is spread, the change of the initial flying speed when the ink droplet is ejected, is measured.

TABLE 2

| | FIG. 10 | Micro-vibration pulse applying condition | Improvement effect of the decapping characteristic | 6 m/s drive voltage (Von) |
|---|---|---|---|---|
| Comparative example 5 | (a) | Not applied | None | 21.2 V |
| Example 3 | (c) | 2AL width Voff | Middle | 21.0 V |
| Example 4 | (f) | 1AL width Voff + 1AL width 0 + 2AL width Voff | Large | 20.5 V |

As shown in Example 3 and Example 4 in Table 2, when the micro-vibration pulse is applied before ejection, it can be confirmed that it is effective in the prevention of the decapping phenomenon under the low temperature and low humidity circumstance. Because of applying the micro-vibration pulse on all pixels, even in a pattern of the ejection of only end portion in the image recording region, the stable droplet formation becomes possible. Further, when the meniscus before ejection is micro-vibrated, the effect of an increase of the drive efficiency (a decrease of the drive voltage) can also be obtained.

(The Evaluation 2 of the Ejection Stability)

Each channel of the recording head of the same shear mode type as the case of the evaluation 1 of the ejection stability is divided into 3 groups, and the ink meniscus extrusive amount from the nozzle when only the micro-vibration pulse in FIG. 10(*f*) is applied is measured by using the measuring apparatus: the digital microscope made by KEYENCE Co.

The result in which the ejection stability is estimated by the following method by using this result and the micro-vibration pulse and ejection pulse shown in the same view, is shown in Table 3.

Condition

Head: AL=2.0 μs

Ink: aqueous ink (viscosity: 5.5 mPa·s, surface tension: 41 mN/m at 25° C.)

Ejection drive voltage: Von=17.8 V, Voff=8.9V (Von/Voff=2/1)

Drive period: 33 μs

Measuring Method of the Ejection Stability

Under the condition in which the ejection drive voltage is fixed and the flying speed of the ink droplet is constant (6 m/s), the flying situation when only the micro-vibration pulse voltage is changed, is observed.

Evaluation Standard of the Ejection Stability

A: no ejection curvature·no mistake-ejection, meniscus is stable,

B: partially, ejection curvature and/or mistake-ejection are generated,

C: ejection curvature and mistake-ejection are generated, meniscus is unstable.

Measuring Method of the Decapping Characteristics:

In each micro-vibration pulse applying condition, the drive voltage is fixed at the value where the flying speed of the ink droplet becomes 6 m/s in regular drive of the ejection head (Von/Voff=2/1), and the change of initial flying speed at the time of ink ejection is observed while increasing the ejection interval in a condition that only the micro-vibration pulse voltage is changed. It is recognized that the smaller the change of initial flying speed, the greater the effect of improvement in the decapping characteristics.

TABLE 3

| | Micro-vibration pulse voltage | Maximum extrusive amount of the meniscus by the micro-vibration pulse | Ejection stability | If there is an effect of improvement in the decapping characteristic |
|---|---|---|---|---|
| Comparative Example 6 | 0 v | 0 μm | A | No |
| Example 5 | 8.9 v | 8.5 μm | A | Yes |
| Example 6 | 10.7 v | 11 μm | A | Yes |
| Comparative Example 7 | 11.6 v | 14 μm | B | Yes |
| Comparative Example 8 | 13.5 v | 18 μm | C | Evaluation impossible |

As shown in Example 5 and Example 6 in Table 3, when the maximum extrusive amount of the meniscus by the micro-vibration pulse is not larger than the nozzle radius (11.5 μm), it can be seen that even just after the micro-vibration pulse is applied, the ejection stability is good. Accordingly, even at the time of high frequency drive, the micro-vibration can always be given to meniscus.

Hereupon, in both of Comparative Example 7 and Comparative Example 8, the maximum extrusive amount of the meniscus is larger than the nozzle radius. In cases where only the micro-vibration pulse is applied, mistake-ejection will not be generated even when the maximum extrusive amount of the meniscus becomes about three times of the nozzle radius, but in cases where the ejection pulse is applied before and after the applying of the micro-vibration pulse, when the maximum extrusive amount of the meniscus becomes larger than the nozzle radius (measured when only the micro-vibration pulse is applied) mistake-ejection tends to be generated. In Comparative Example 7, mistake-ejections are partially generated among the all nozzles of the recording head, and in Comparative Example 8, mistake-ejections are generated entirely.

What is claimed is:

1. A droplet ejection apparatus comprising:

a drive signal generator for generating a set of drive signals including a plurality of drive pulses;

a drive pulse selector for selecting a set of drive pulses in accordance with a print datum of each pixel; and a head for ejecting a droplet from a nozzle corresponding to a channel, by changing a volume of the channel in accordance with the selected set of drive pulses;

wherein the drive signal includes a micro-vibration pulse as at least one of the drive pulses to generate a micro-vibration of a meniscus in the nozzle in such a degree that the droplet is not ejected, said micro-vibration pulse comprising at least one rectangular wave, including at least one rectangular wave which has a pulse width of (2n) AL, where AL is ½ of an acoustic resonance period of the channel, and n is an integer not smaller than 1.

2. The droplet ejection apparatus of claim 1, wherein the micro-vibration pulse includes a rectangular wave having a pulse width of 2 AL.

3. The droplet ejection apparatus of claim 1, wherein the micro-vibration pulse includes a rectangular wave having a pulse width of 1 AL and a rectangular wave having a pulse width of 2 AL.

4. The droplet ejection apparatus of claim 1, wherein the micro-vibration pulse is applied before an ejection pulse for ejecting the droplet is applied.

5. The droplet ejection apparatus of claim 1, wherein the rectangular wave having a pulse width of (2n) AL is applied at a last timing of the micro-vibration pulse.

6. The droplet ejection apparatus of claim 5, wherein an ejection pulse for ejecting the droplet is applied after 1 AL from a time when the rectangular wave having the pulse width of (2n) AL is applied at the last timing of the micro-vibration pulse.

7. The droplet ejection apparatus of claim 1, wherein an ejection pulse for ejecting the droplet comprises:

a first pulse formed of a rectangular wave to expand the volume of the channel, and 1 AL later, to restore the volume of the channel to an original state; and a second pulse formed of a rectangular wave to reduce the volume of the channel, and a prescribed period later, to restore the volume of the channel to the original state, wherein a voltage of the first pulse Von is higher than a voltage of the second pulse Voff.

8. The droplet ejection apparatus of claim 7, wherein at least one rectangular wave of the micro-vibration pulse reduces the volume of the channel, and subsequently restores the volume of the channel to the original state, and a voltage of the micro-vibration pulse is the same as the voltage Voff of the second pulse in the ejection pulse.

9. The droplet ejection apparatus of claim 1, wherein a maximum extrusive amount of the meniscus by the micro-vibration pulse is not larger than a radius of the nozzle.

10. The droplet ejection apparatus of claim 1, wherein the head comprises an electrical-mechanical conversion element which changes the volume of the channel in accordance with application of at least one of the ejection pulse and the micro-vibration pulse.

11. The droplet ejection apparatus of claim 10, wherein the electrical-mechanical conversion element comprises a piezoelectric material which forms a partition wall between adjacent channels, and which is deformed in a shearing mode by applying a voltage.

12. The droplet ejection apparatus of claim 1, wherein the droplet is an ink droplet.

13. A drive method for a droplet ejection head, comprising:

generating a set of drive signals including a plurality of drive pulses by a drive signal generator;

selecting a set of drive pulses in accordance with a print datum of each pixel by a drive pulse selector;

ejecting a droplet from a nozzle of the droplet ejection head corresponding to a channel, by changing a volume of the channel in accordance with the selected set of drive pulses selected;

wherein the drive signal includes a micro-vibration pulse as at least one of the drive pulses to generate a micro-vibration of a meniscus in the nozzle in such a degree that the droplet is not ejected, said micro-vibration pulse comprising at least one rectangular wave, including at least one rectangular wave which has a pulse width of (2n) AL, where AL is ½ of an acoustic resonance period of the channel, and n is an integer not smaller than 1.

14. The drive method of claim 13, wherein the micro-vibration pulse includes a rectangular wave having a pulse width of 2 AL.

15. The drive method of claim 13, wherein the micro-vibration pulse includes a rectangular wave having a pulse width of 1 AL and a rectangular wave having a pulse width of 2 AL.

16. The drive method of claim 13, wherein the micro-vibration pulse is applied before an ejection pulse for ejecting the droplet is applied.

17. The drive method of claim 13, wherein the rectangular wave having the pulse width of (2n) AL is applied at a last timing of the micro-vibration pulse.

18. The drive method of claim 17, wherein an ejection pulse for ejecting the droplet is applied after 1 AL from a time when the rectangular wave having the pulse width of (2n) AL is applied at the last timing of the micro-vibration pulse.

19. The drive method of claim 13, wherein an ejection pulse for ejecting the droplet comprises:

a first pulse formed of a rectangular wave for expanding the volume of the channel, and 1 AL later, restoring the volume of the channel to an original state; and a second pulse formed of a rectangular wave for reducing the volume of the channel, and a prescribed period later, restoring the volume of the channel to the original state, wherein a voltage of the first pulse Von is higher than a voltage of the second pulse Voff.

20. The drive method of claim 19, wherein at least one rectangular wave of the micro-vibration pulse reduces the volume of the channel, and subsequently restores the volume of the channel to the original state, and a voltage of the micro-vibration pulse is the same as the voltage of the second pulse Voff.

21. The drive method of claim 13, wherein a maximum extrusive amount of the meniscus by the micro-vibration pulse is not larger than a radius of the nozzle.

22. The drive method of claim 13, wherein the head comprises an electrical-mechanical conversion element for changing the volume of the channel in accordance with application of at least one of the ejection pulse and the micro-vibration pulse.

23. The drive method of claim 22, wherein the electrical-mechanical conversion element comprises a piezoelectric material which forms a partition wall between adjacent channels, and which is deformed in a shearing mode by applying a voltage.

24. The drive method of claim 13, wherein the droplet is an ink droplet.

* * * * *